US009436115B2

(12) United States Patent
Yamaguchi et al.

(10) Patent No.: US 9,436,115 B2
(45) Date of Patent: Sep. 6, 2016

(54) CLEANING MEMBER HAVING A CLEANING MATERIAL SPIRALLY WOUND AROUND A SHAFT MATERIAL, CHARGING APPARATUS, AND IMAGE FORMING APPARATUS

(71) Applicant: FUJI XEROX CO., LTD., Tokyo (JP)

(72) Inventors: Mikio Yamaguchi, Kanagawa (JP); Hiroki Ando, Kanagawa (JP)

(73) Assignee: FUJI XEROX CO., LTD., Toyko (JP)

( * ) Notice: Subject to any disclaimer, the term of this patent is extended or adjusted under 35 U.S.C. 154(b) by 0 days.

(21) Appl. No.: 14/517,013

(22) Filed: Oct. 17, 2014

(65) Prior Publication Data

US 2015/0331349 A1 Nov. 19, 2015

(30) Foreign Application Priority Data

May 16, 2014 (JP) ..... 2014-102638

(51) Int. Cl.
*G03G 15/02* (2006.01)

(52) U.S. Cl.
CPC ..... *G03G 15/0225* (2013.01); *G03G 15/0258* (2013.01)

(58) Field of Classification Search
USPC ..... 399/100, 166; 15/339, 183
See application file for complete search history.

(56) References Cited

U.S. PATENT DOCUMENTS 4,777,691 A * 10/1988 Richmond ..... A47L 9/0477 15/182
5,435,038 A * 7/1995 Sauers ..... A47L 9/0455 15/179
6,212,732 B1 * 4/2001 Tajima ..... A47L 9/04 15/339

FOREIGN PATENT DOCUMENTS

JP 2008033170 A * 2/2008
JP A-2010-286712 12/2010
JP A-2013-145415 7/2013

* cited by examiner

*Primary Examiner* — Quana M Grainger
(74) *Attorney, Agent, or Firm* — Oliff PLC

(57) ABSTRACT

Provided is a cleaning member, including a shaft material that rotates about an axial center, and a cleaning material that is spirally wound around the shaft material, is driven to be rotated by a rotating member to be cleaned, cleans the member to be cleaned, and has the number of windings which is equal to or greater than 1 and less than 2 in a cleaning area where the member to be cleaned is cleaned.

6 Claims, 9 Drawing Sheets

CLEANING MEMBER HAVING A CLEANING MATERIAL SPIRALLY WOUND AROUND A SHAFT MATERIAL, CHARGING APPARATUS, AND IMAGE FORMING APPARATUS

CROSS-REFERENCE TO RELATED APPLICATIONS

This application is based on and claims priority under 35 USC 119 from Japanese Patent Application No. 2014-102638 filed May 16, 2014.

BACKGROUND

Technical Field

The present invention relates to a cleaning member, a charging apparatus, and an image forming apparatus.

SUMMARY

According to an aspect of the invention, there is provided a cleaning member, including:

a shaft material that rotates about an axial center; and a cleaning material that is spirally wound around the shaft material, is driven to be rotated by a rotating member to be cleaned, cleans the member to be cleaned, and has the number of windings which is equal to or greater than 1 and less than 2 in a cleaning area where the member to be cleaned is cleaned.

BRIEF DESCRIPTION OF THE DRAWINGS

Exemplary embodiments of the present invention will be described in detail based on the following figures, wherein.

DETAILED DESCRIPTION (First Exemplary Embodiment)

Figure 1A:
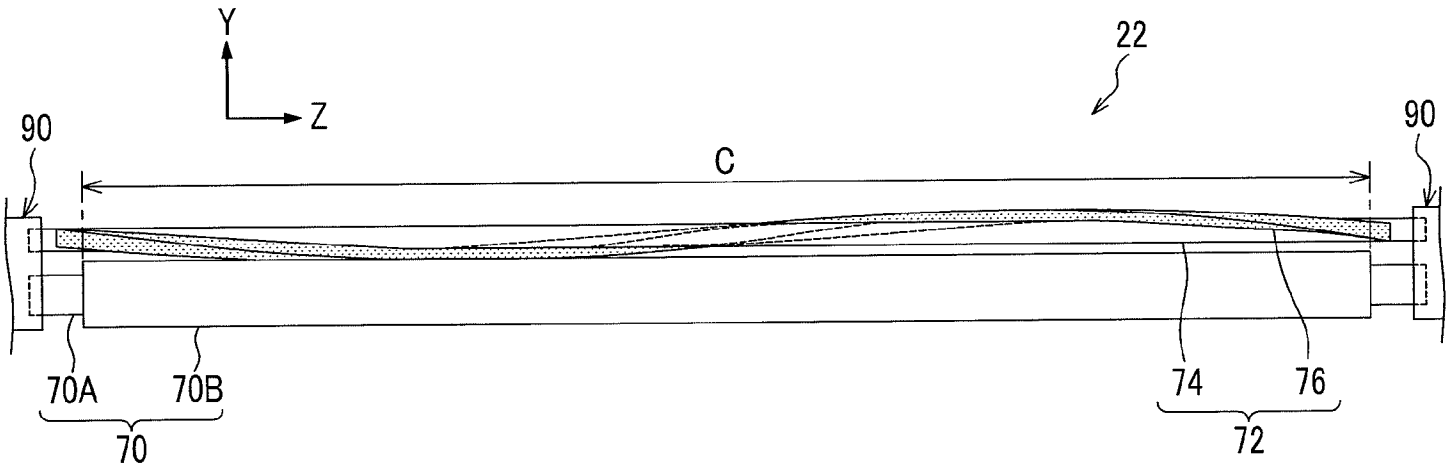
FIGS. 1A and 1B are a front view illustrating a charging apparatus and an enlarged front view of a cleaning member according to a first exemplary embodiment of the present invention.

An example of a cleaning member, a charging apparatus, and an image forming apparatus according to a first exemplary embodiment of the present invention will be described with reference to FIGS. 1A to 6. In addition, an arrow Y direction illustrated in the drawings is a vertical direction and illustrates an apparatus up-and-down direction. An arrow X direction is a horizontal direction and illustrates an apparatus width direction. An arrow Z direction is a horizontal direction and illustrates an apparatus depth.

Entire Configuration

Figure 6:
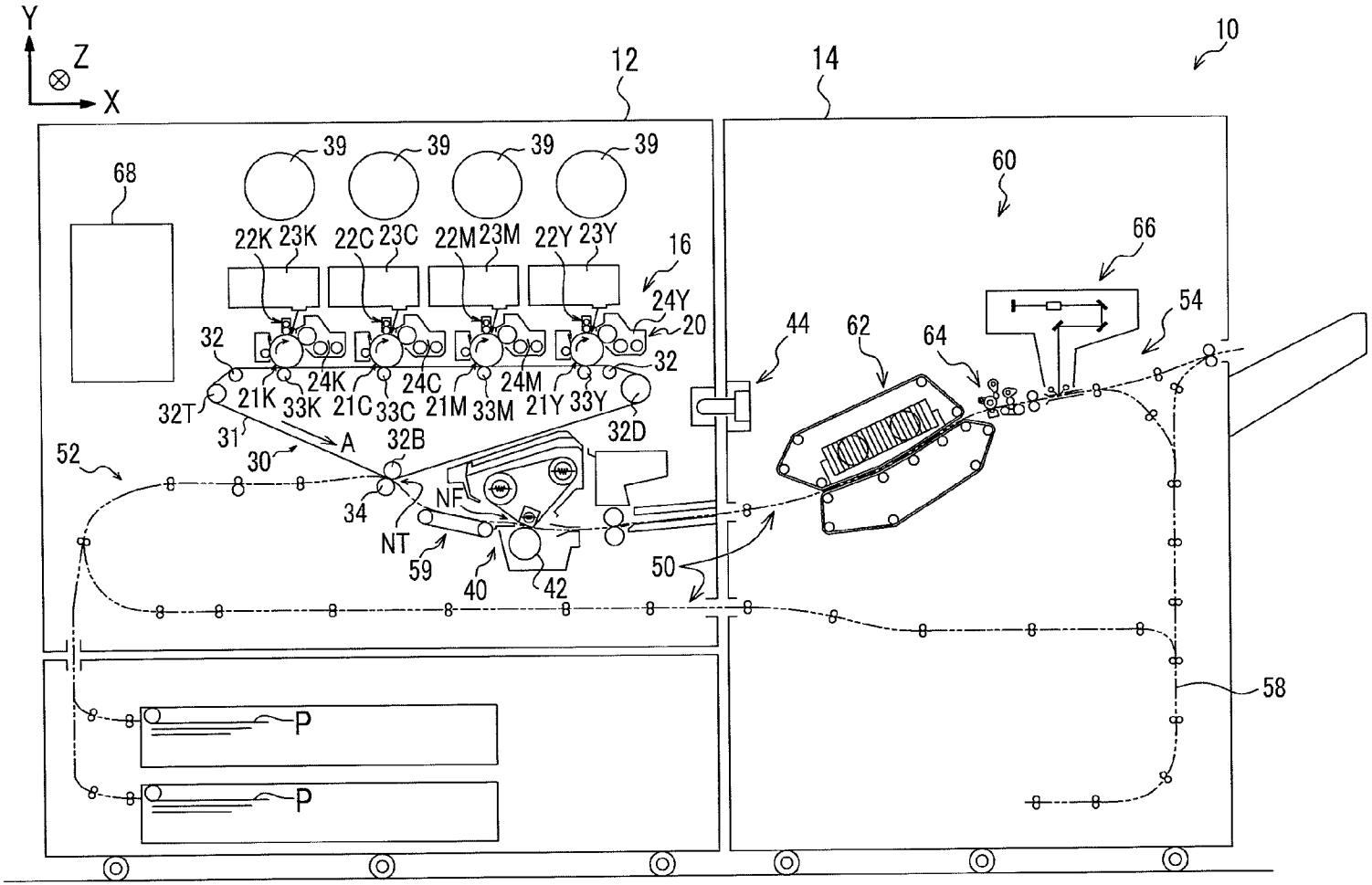
FIG. 6 is a schematic configuration view illustrating the image forming apparatus according to the first exemplary embodiment of the present invention.

As illustrated in FIG. 6, an image forming apparatus 10 includes a first housing 12, a second housing 14, an image forming portion 16, a medium transporting portion 50, a post-processing portion 60, and a control portion 68. In addition, the control portion 68 performs a control of each portion (each portion that constitutes the image forming portion 16, or the like) that constitutes the image forming apparatus 10.

In addition, the first housing 12 and the second housing 14 are disposed to be aligned in the apparatus width direction, and are connected to each other by a connecting mechanism 44.

Image Forming Portion 16

Figure 5:
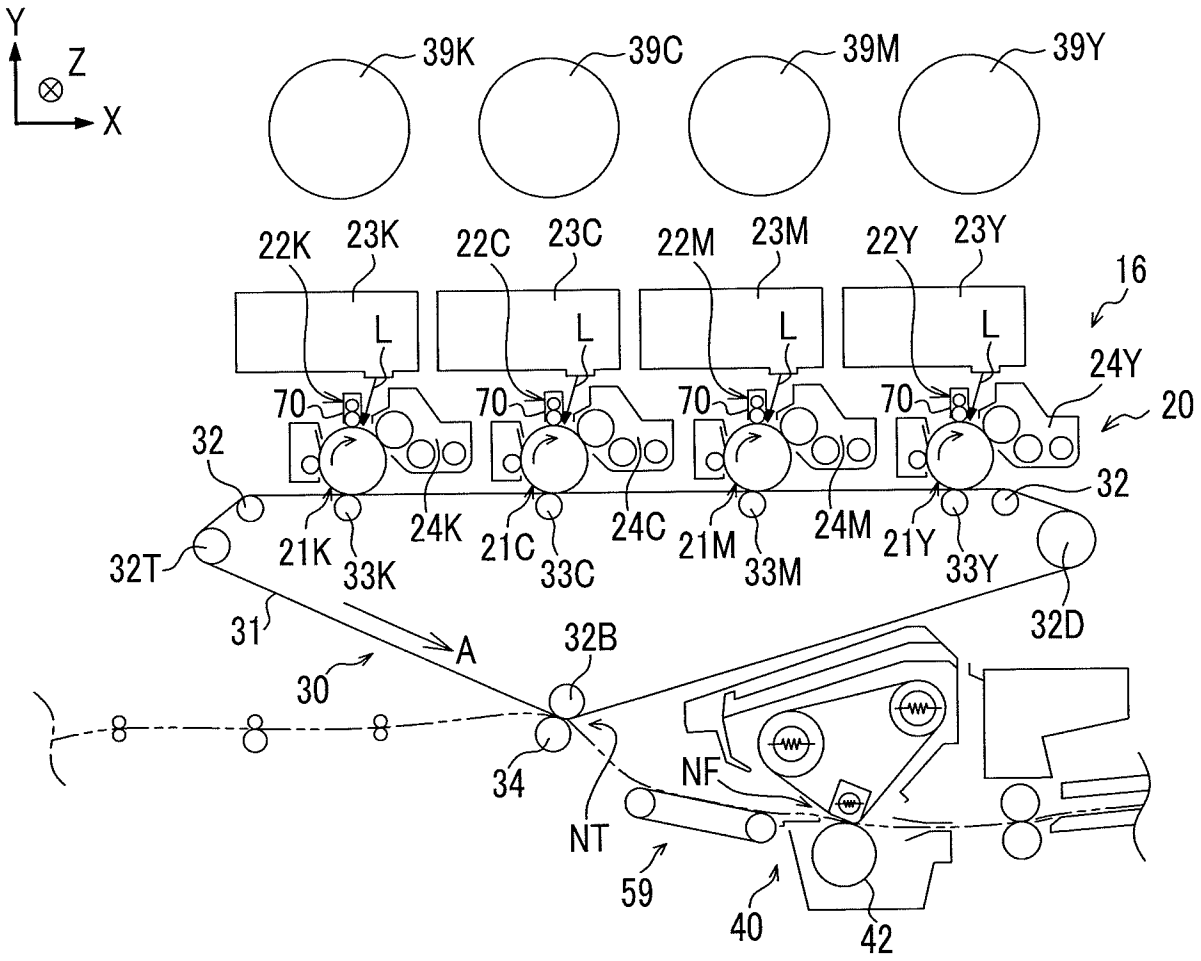
FIG. 5 is a configuration view illustrating a toner image forming portion or the like of an image forming apparatus according to the first exemplary embodiment of the present invention.

The image forming portion 16 is disposed inside the first housing 12, and as illustrated in FIG. 5, is provided with a toner image forming portion 20 which forms a toner image and a transfer apparatus 30 which transfers an image formed by the toner image forming portion 20 to a sheet member P that functions as a recording medium. Furthermore, the image forming portion 16 is provided with a fixing device 40 which fixes the toner image transferred to the sheet member P onto the sheet member P. In addition, the image forming portion forms the image on the sheet member P by an electrophotographic process.

Toner Image Forming Portion 20

The toner image forming portion 20 includes a photoconductor drum 21 as an example of an image holding member, a charging apparatus 22, an exposure device 23, and a developing device 24. Plural toner image forming portions 20 are provided to form the toner images for every color. In the exemplary embodiment, the toner image forming portions 20 of total four colors, such as yellow (Y), magenta (M), cyan (c), and black (K), are provided. In addition, the toner image forming portions 20 of each color are configured similarly to each other. In a circulating direction of a transfer belt 31 provided in the transfer apparatus 30, the toner image forming portions 20 of each color are disposed in the order of yellow (Y), magenta (M), cyan (c), and black (K), from an upstream side. In addition, the photoconductor drums 21 of each color are in contact with the transfer belt 31. The toner image forming portions 20 of each color are aligned in the apparatus width direction. In addition, when it is not necessary to distinguish Y, M, C, and K for the description, Y, M, C, and K will be omitted from the description.

The photoconductor drum 21 is formed in a cylindrical shape, and is made to be rotationally driven around a shaft of its own by a driving unit (not illustrated). On an outer circumferential surface of the photoconductor drum 21, a photosensitive layer which exhibits a negative charging polarity is formed as an example. In addition, an overcoat layer may be formed on the outer circumferential surface of the photoconductor drum 21.

The charging apparatus 22 is provided with a charging roller 70 as an example of a charging member which comes into contact with the outer circumferential surface (photosensitive layer) of the photoconductor drum 21, rotates while being driven by the rotating photoconductor drum 21, and charges the outer circumferential surface of the photoconductor drum 21 with a negative polarity. The charging apparatus 22 will be described in detail later.

The exposure device 23 forms an electrostatic latent image on the outer circumferential surface of the photoconductor drum 21. Specifically, according to image data received from an image signal processing portion which constitutes the control portion 68, the exposure device 23 irradiates the outer circumferential surface of the photoconductor drum 21 charged by the charging apparatus 22 with modulated exposure light L. By the irradiation of the exposure light L, the electrostatic latent image is formed on the outer circumferential surface of the photoconductor drum 21.

In the exemplary embodiment, the exposure device 23 is configured to expose the outer circumferential surface of the photoconductor drum 21 while scanning a light beam emitted from a light source (not illustrated) by an optical scanning unit (optical system) including a polygon mirror or an FO lens.

By developing the electrostatic latent image formed on the outer circumferential surface of the photoconductor drum 21 as the toner image by a developer G including a toner T (an example of powder) and a carrier CA, the developing device 24 forms the toner image on the outer circumferential surface of the photoconductor drum 21. A toner cartridge 39 for replenishing the toner T to the developing device 24 is linked to the developing device 24 via a transporting path (not illustrated). The toner cartridges 39 of each color are disposed to be aligned in the apparatus width direction above the exposure device 23, and is detachable (exchangeable) with respect to the first housing 12 individually.

The transfer apparatus 30 is provided with the endless transfer belt 31 which transfers the toner images of the photoconductor drums 21 of each color. The posture of the transfer belt 31 is determined by being wound around plural rollers 32. In the exemplary embodiment, the transfer belt 31 has a posture of a triangle shape having a long reverse obtuse angle in the apparatus width direction when viewed from a front view side.

A roller 32D among the plural rollers 32 functions as a driving roller which makes the transfer belt 31 circulate in the arrow A direction by a power of a motor (not illustrated). In addition, a roller 32T among the plural rollers 32 functions as a tension applying roller which applies a tension to the transfer belt 31. A roller 32B among the plural rollers 32 functions as a facing roller of a secondary transfer roller 34 which will be described later.

Furthermore, on a side opposite to the photoconductor drums 21 of each color with the transfer belt 31 therebetween, a primary transfer roller 33 which transfers the toner image formed on the outer circumferential surface of the photoconductor drum 21 to the transfer belts 31 are disposed, respectively.

Furthermore, the secondary transfer roller 34, which transfers the toner image transferred to the transfer belt 31, to the sheet member P comes into contact with a top of a lower end side of the transfer belt 31 which makes an obtuse angle, and a transfer nip NT is formed by the transfer belt 31 and the secondary transfer roller 34.

The fixing device 40 fixes the toner image onto the sheet member P to which the toner image is transferred in the transfer apparatus 30. In the exemplary embodiment, by applying pressure while heating the toner image in a fixing nip NF, the fixing device 40 fixes the toner image onto the sheet member P.

Medium Transporting Portion 50

As illustrated in FIG. 6, the medium transporting portion 50 includes: a medium supply portion 52 which supplies the sheet member P to the image forming portion 16; and a medium discharge portion 54 which discharges the sheet member P on which the image is formed. Furthermore, the medium transporting portion 50 includes: a medium returning portion 58 which is used at a time of forming the image on both surfaces of the sheet member P; and an intermediate transporting portion 59 which transports the sheet member P from the transfer apparatus 30 to the fixing device 40.

The medium supply portion 52 supplies the sheet member P one by one in accordance with a transfer timing, with respect to the transfer nip NT of the image forming portion 16. In contrast, the medium discharge portion 54 discharges the sheet member P on which the toner image is fixed by the fixing device 40, to the outside of the apparatus. Furthermore, at a time of forming an image on the other surface of the sheet member P which has the toner image fixed onto one surface thereof, the medium returning portion 58 reverses front and rear surfaces of the sheet member P and returns the sheet member P to the image forming portion 16 (medium supply portion 52).

Post-Processing Portion 60

As illustrated in FIG. 6, the post-processing portion 60 is disposed inside the second housing 14, and includes: a medium cooling portion 62 which cools the sheet member P on which the image is formed; a correction device 64 which corrects a curve of the sheet member P; and an image inspection portion 66 which inspects the image.

Each portion which constitutes the post-processing portion 60 is disposed in the medium discharge portion 54 of the medium transporting portion 50. The medium cooling portion 62, the correction device 64, and the image inspection portion 66 are disposed in this order from the upstream side of the discharging direction of the sheet member P.

Image Forming Operation

Next, an image forming process to the sheet member P by the image forming apparatus 10 and a post-processing process will be described schematically.

The control portion 68 which receives an image forming command operates the toner image forming portion 20, the transfer apparatus 30, and the fixing device 40. Accordingly, the photoconductor drum 21 and a developing roller (reference numeral is omitted) provided in the developing device 24 are rotated, and the transfer belt 31 is circulated. Furthermore, a pressure roller 42 provided in the fixing device 40 is rotated, and a fixing belt (reference numeral is omitted) is circulated. In synchronization with the operations, the control portion 68 operates the medium transporting portion 50 or the like.

Accordingly, the photoconductor drums 21 of each color are charged by the charging apparatus 22 while being rotated. In addition, the control portion 68 sends image data which is image-processed by the image signal processing portion, to the exposure devices 23 of each color. The exposure devices 23 of each color inject the exposure light L of each color according to the image data, and exposes the charged photoconductor drums 21 of each color to the exposure light L. The electrostatic latent images are formed on the outer circumferential surfaces of the photoconductor drums 21 of each color. The electrostatic latent images formed on the photoconductor drums 21 of each color are developed as the toner image by the developer G supplied from the developing device 24. Accordingly, on the photoconductor drums 21 of each color, the toner image of corresponding color, among yellow (Y), magenta (M), cyan (C), and black (K), is formed.

Furthermore, the toner images of each color formed on the photoconductor drums 21 of each color are sequentially transferred to the transfer belt 31 which is circulated by the primary transfer rollers 33 of each color. Accordingly, on the transfer belt 31, a toner image in which the toner images of four colors are overlapped is formed. The toner image is transported to the transfer nip NT by the circulation of the transfer belt 31. The sheet member P is supplied by the medium supply portion 52 to the transfer nip NT so as to be in accordance with the timing to the transport of the toner image. By applying a transfer bias voltage in the transfer nip NT, the toner image is transferred from the transfer belt 31 to the sheet member P.

The sheet member P to which the toner image is transferred is transported while being aspirated by the negative pressure toward the fixing nip NF of the fixing device 40 from the transfer nip NT of the transfer apparatus 30 by the intermediate transporting portion 59. The fixing device 40 applies heat and pressure (fixing energy) to the sheet member P which passes through the fixing nip NF. Accordingly, the toner image transferred to the sheet member P is fixed to the sheet member P.

While the sheet member P discharged from the fixing device 40 is transported toward a discharge medium receiving portion on the outside of the apparatus by the medium discharge portion 54, the processing is performed by the post-processing portion 60. First, the sheet member P heated by the fixing device 40 is cooled in the medium cooling portion 62. Next, a curve of the sheet member P is corrected by the correction device 64. Furthermore, a presence/absence or a degree of, for example, a toner density failure, an image failure, or an image position failure, of the toner image fixed onto the sheet member P is detected by the image inspection portion 66. Then, the sheet member P is discharged to the outside of the second housing 14 by the medium discharge portion 54.

Meanwhile, in a case (a case of duplex printing) where the image is formed on a non-image surface (rear surface) of the sheet member P where the image is not formed, the control portion 68 switches the transporting route of the sheet member P which passes through the image inspection portion 66 from the medium discharge portion 54 to the medium returning portion 58. Accordingly, the front and the rear surfaces of the sheet member P are reversed and the sheet member P is fed to the medium supply portion 52. On the rear surface of the sheet member P, the image is formed (fixed) by a process similar to the above-described process, and the sheet member P is discharged to the outside of the second housing 14 by the medium discharge portion 54.

Main Portion Configuration

Next, the charging apparatus 22 will be described.

Figure 3:
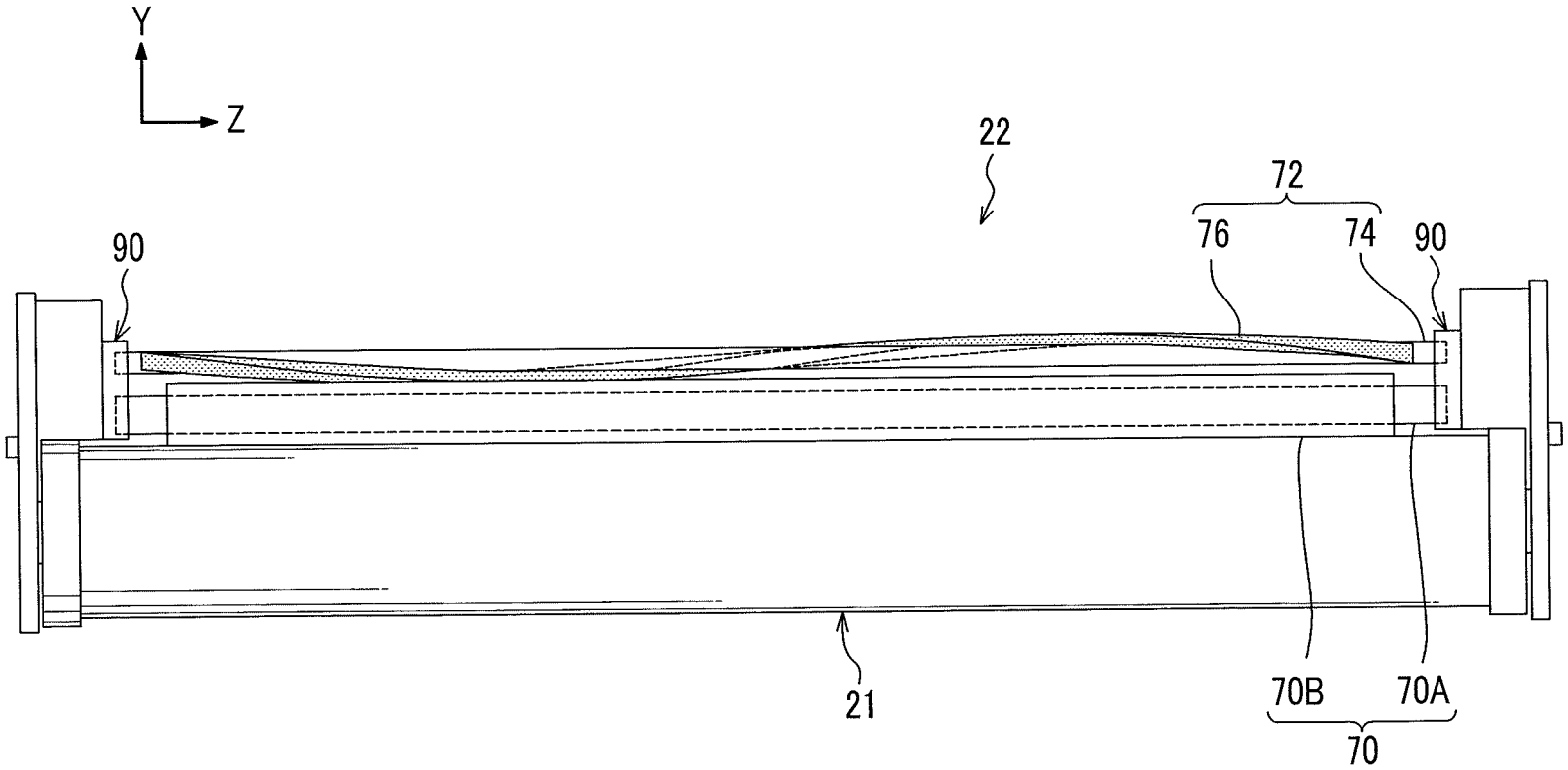
FIG. 3 is a front view illustrating the charging apparatus and an image holding member according to the first exemplary embodiment of the present invention.

As illustrated in FIG. 3, the charging apparatus 22 is disposed on an upper side of the photoconductor drum 21, and includes: the charging roller 70 (an example of the charging member) which charges the outer circumferential surface of the photoconductor drum 21 with the negative polarity; and a cleaning member 72 which cleans the outer circumferential surface of the charging roller 70. Furthermore, the charging apparatus 22 includes a pair of supporting members 90 which supports the charging roller 70 and the cleaning member 72 to be rotatable.

Charging Roller 70

The charging roller 70 includes: a columnar shaft member 70A which extends in the apparatus depth direction; and a cylindrical roller portion 70B through which the shaft member 70A passes. As an example, the roller portion 70B is formed of a rubber material. An outer diameter of the roller portion 70B is 9 mm, and a length of the roller portion 70B is 224 mm.

As illustrated in FIG. 3, the charging roller 70 comes into contact with the outer circumferential surface of the photoconductor drum 21 from the upper side of the photoconductor drum 21. Furthermore, the shaft member 70A of the charging roller 70 is supported to be rotatable by the pair of supporting members 90 which are disposed at both end portions of the charging roller 70.

In this configuration, the charging roller 70 is driven to be rotated by the rotating photoconductor drum 21. As the voltage is applied from a power supply (not illustrated) to the charging roller 70 which is driven to be rotated by the photoconductor drum 21, the charging roller 70 charges the outer circumferential surface of the photoconductor drum 21.

Cleaning Member 72

As illustrated in FIG. 3, the cleaning member 72 includes: a core material 74 (an example of a shaft material) which is in a columnar shape that extends in the apparatus depth direction; and a cleaning material 76 which is spirally wound around the outer circumferential surface of the core material 74. The cleaning material 76 of the cleaning member 72 comes into contact with the outer circumferential surface of the roller portion 70B of the charging roller 70 from the upper side of the charging roller 70. Furthermore, the core material 74 of the cleaning member 72 is supported to be rotatable by the pair of supporting members 90 which are disposed at both end portions of the cleaning member 72. In other words, the core material 74 is supported to be rotatable around an axial center of the core material 74, by the supporting member 90.

As an example, the core material 74 is molded by a resin material (for example, a polyacetal resin). An outer diameter of the core material 74 is 4 mm, and a length of the core material 74 is 270 mm.

Meanwhile, as an example, the cleaning material 76 is molded with a foaming urethane resin, and a cross section thereof in a direction which is perpendicular to a longitudinal direction is rectangular in a free state where the cleaning material 76 is not wound around the outer circumferential surface of the core material 74. In addition, as an example, a cross-sectional shape in a free state has a width of 5 mm and a thickness (height) of 3 mm.

Figure 4A:
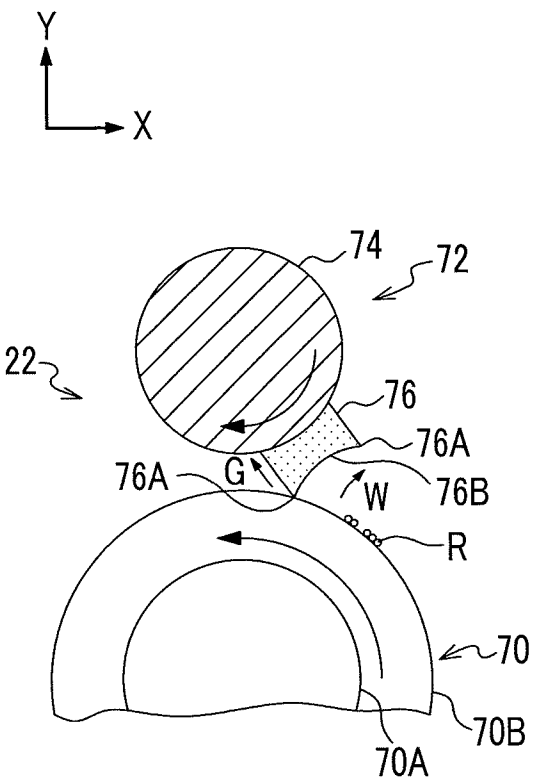
FIGS. 4A, 4B, and 4C are flowcharts illustrating a cleaning process of a charging roller by the cleaning member according to the first exemplary embodiment of the present invention.

By using a duplex tape (not illustrated), the cleaning material 76 is anchored on the outer circumferential surface of the core material 74. In addition, in a state where the cleaning material 76 is wound around the core material 74, as illustrated in FIG. 4A, both end portions 76A in a width direction in the cleaning material 76 is protruded (stand to be bent) in a radial direction of the core material 74 from a center portion 76B.

Next, the number of windings of the cleaning material 76 with respect to the core material 74 will be described.

As illustrated in FIG. 1A, both end portions of the cleaning material 76 which is wound around the core material 74 is disposed on the outer side, with respect to a cleaning area C (area C in the drawing: an area in which the charging roller 70 is cleaned) in which the core material 74 faces the roller portion 70B of the charging roller 70.

Figure 1B:
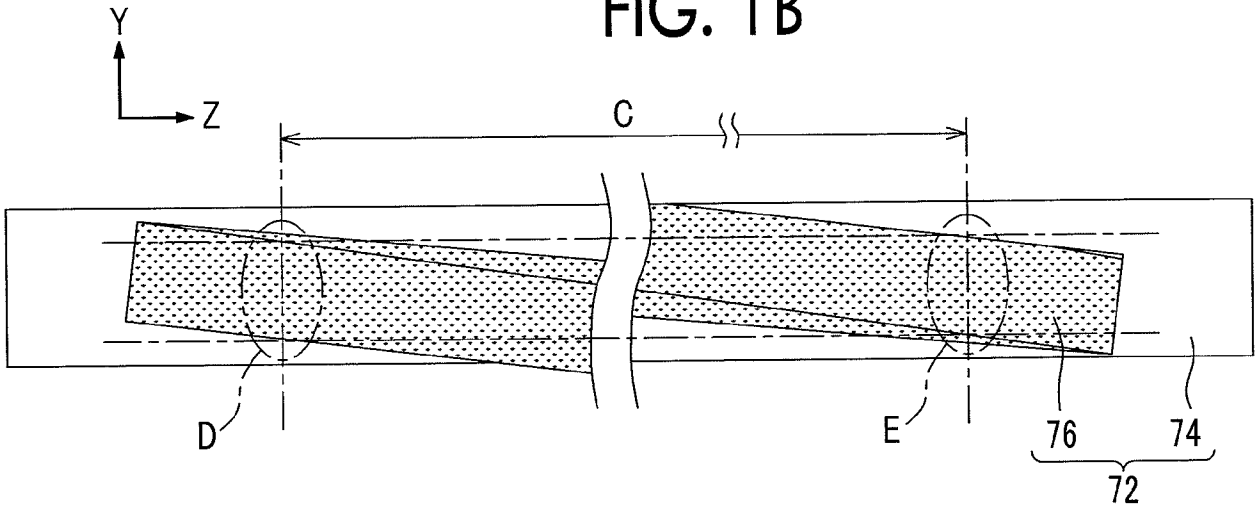

The number of windings of the cleaning material 76 in the cleaning area C is 1 (1 winding). In other words, as illustrated in FIG. 1B, only an attaching position of the cleaning material 76 in a left end portion in the drawing (D portion in the drawing) of the cleaning area C and an attaching position of the cleaning material 76 in a right end portion in the drawing (E portion in the drawing) of the cleaning area C are similar (same) to each other in a circumferential direction of the core material 74. In other words, a center of the cleaning material 76 in the left end portion in the drawing of the cleaning area C and a center of the cleaning material 76 in the right end portion in the drawing of the cleaning area C are similar (same) to each other in the circumferential direction of the core material 74.

In addition, an attaching irregularity of the cleaning material 76 in the circumferential direction of the core material 74 is 15% of a circumferential length of the core material 74. In the exemplary embodiment, since the circumferential length of the core material 74 is 12.5 mm, 15% of the circumferential length of the core material 74 is 1.9 mm. For this reason, even when the attaching position of the cleaning material 76 in the left end portion in the drawing of the cleaning area C and the attaching position of the cleaning material 76 in the right end portion in the drawing of the cleaning area C are deviated by 15% (1.9 mm) of the circumferential length in the circumferential direction of the core material 74, the number of windings of the cleaning material 76 is regarded as 1 (1 winding).

In this configuration, the cleaning material 76 comes into contact with the roller portion 70B of the rotating charging roller 70, and the cleaning member 72 is driven to be rotated. Accordingly, the roller portion 70B is cleaned.

Supporting Member 90

Figure 2:
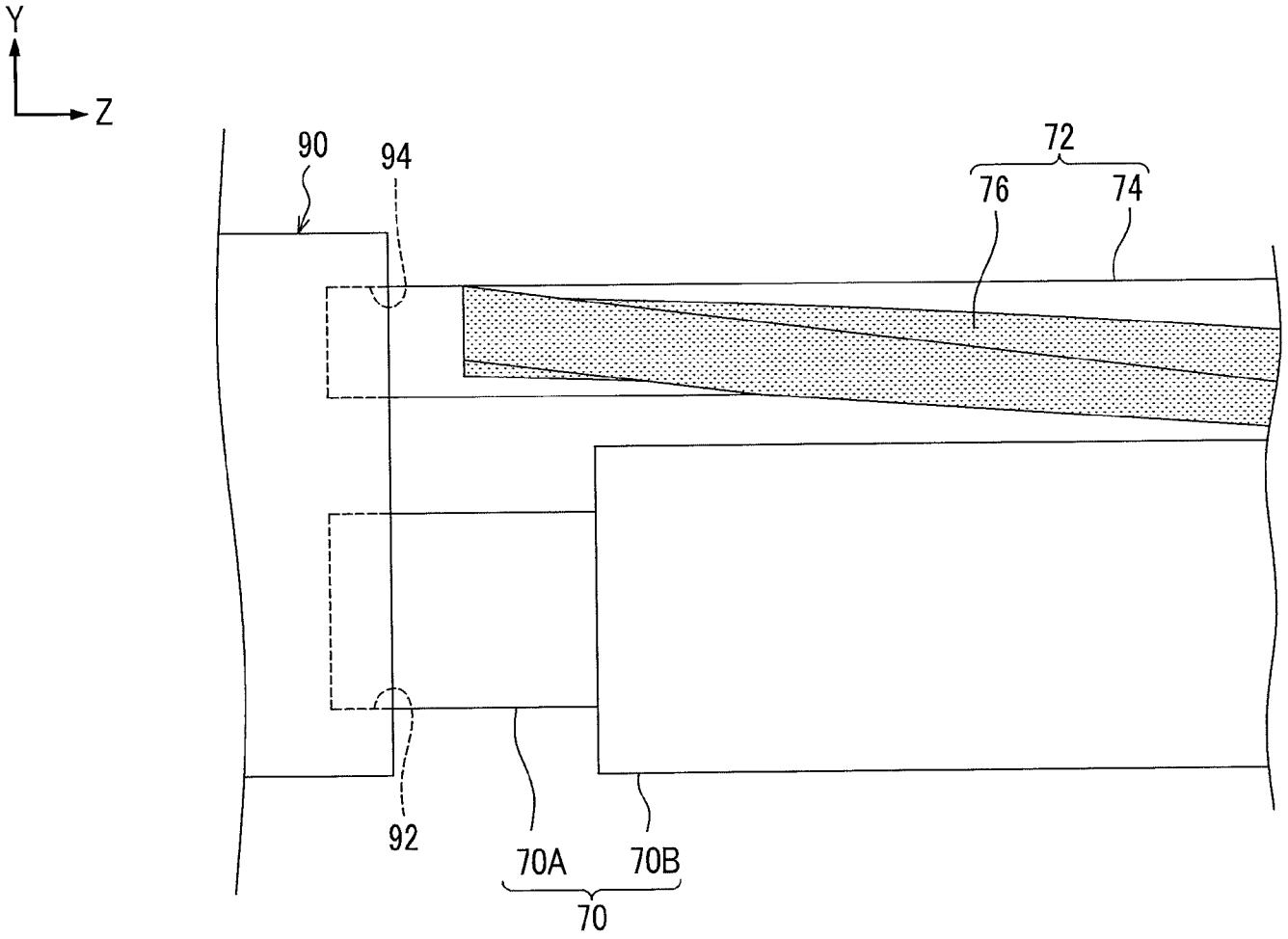
FIG. 2 is an enlarged front view illustrating the charging apparatus according to the first exemplary embodiment of the present invention.

As illustrated in FIG. 3, the supporting members 90 which support the charging roller 70 and the cleaning member 72 to be rotatable are disposed at both end portions of the cleaning member 72, respectively. As illustrated in FIG. 2, in the supporting member 90, a recess 92 into which an end portion of the shaft member 70A is inserted and a recess 94 into which an end portion of the core material 74 is inserted, are formed.

By inserting the end portion of the shaft member 70A into the recess 92 and the end portion of the core material 74 into the recess 94, the shaft member 70A and the core material 74 are disposed at an interval determined in advance.

Operation

Next, regarding an operation of the charging apparatus 22, an operation in which the cleaning member 72 cleans the outer circumferential surface of the charging roller 70 by removing an attached matter, such as a toner external additive, attached to the outer circumferential surface of the roller portion 70B of the charging roller 70, will be described.

Figure 4B:
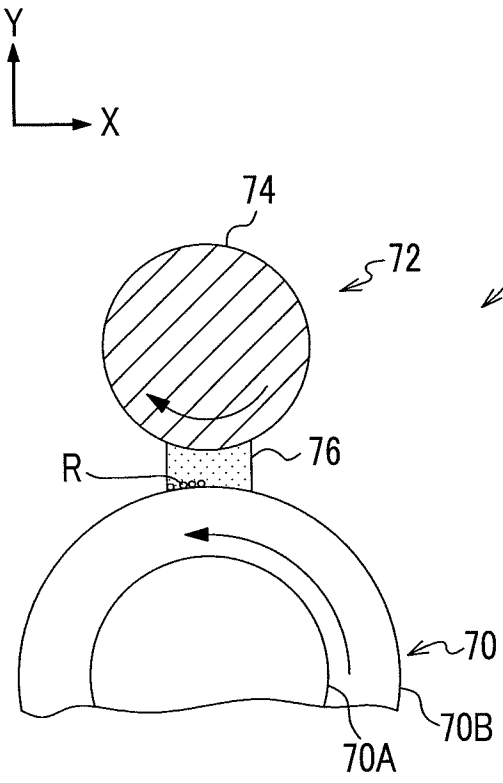
Figure 4C:
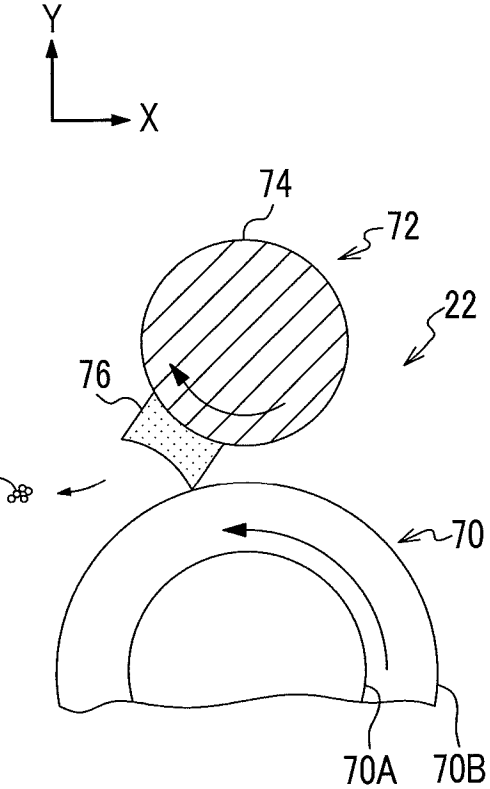

The cleaning material 76 comes into contact with the roller portion 70B of the rotating charging roller 70, and the cleaning member 72 is driven to be rotated. As illustrated in FIGS. 4A and 4B, an attached matter R which is attached on the outer circumferential surface of the roller portion 70B of the charging roller 70 that rotates in an arrow direction, is pressed by one of the end portions 76A of the cleaning material 76 of the cleaning member 72 that is driven to be rotated and aggregated. In particular, as one of the end portions 76A of the cleaning material 76 is pushed to the outer circumferential surface of the roller portion 70B and is elastically deformed (elastically compressed) in a thickness direction (G direction illustrated in FIG. 4A) and the width direction (W direction illustrated in FIG. 4A) of the cleaning member 72, the attached matter R is aggregated by being pressed by the cleaning material 76. As illustrated in FIG. 4C, as the end portion 76A of the cleaning material 76 of the cleaning member 72 which is driven to be rotated is restored, the aggregated attaching matter R is loosened from the aggregated state by a restoring force and is repelled from the outer circumferential surface of the roller portion 70B. In this manner, the cleaning member 72 cleans the outer circumferential surface of the roller portion 70B (charging roller 70).

Here, the number of windings of the cleaning material 76 with respect to the core material 74 in the cleaning area C is 1 (1 winding). For this reason, when the cleaning member 72 is driven to be rotated by the charging roller 70, the cleaning material 76 and the roller portion 70B come into contact with each other at one location except for a case where the cleaning material 76 and the roller portion 70B of the charging roller 70 come into contact with each other in both end portions of the cleaning area C.

CONCLUSION

In this manner, as the number of windings of the cleaning material 76 with respect to the core material 74 in the cleaning area C is 1, the cleaning material 76 of the rotating cleaning member 72 and the roller portion 70B always come into contact with each other by changing a contact part. For this reason, compared to a case where the number of windings is less than 1, a failure in driven rotation of the cleaning member 72 is suppressed.

In addition, when the cleaning material 76 and the roller portion 70B come into contact with each other at one location and the cleaning member 72 rotates, even when the core material 74 bends as a result that the cleaning material 76 and the roller portion 70B come into contact with each other, the cleaning material 76 and the roller portion 70B come into contact with each other at one location. In addition, at both end portions of the cleaning area C, in a case where the cleaning material 76 and the roller portion 70B come into contact with each other, the position where the cleaning material 76 and the roller portion 70B come into contact with each other is close to the supporting member 90, compared to a case where the cleaning material 76 and the roller portion 70B come into contact with each other at the center portion of the cleaning area C. For this reason, a bending amount of the core material 74 of a portion at which the cleaning material 76 comes into contact with the roller portion 70B is small, and the cleaning material 76 and the roller portion 70B come into contact with each other effectively.

As described above, as the number of windings of the cleaning material 76 with respect to the core material 74 in the cleaning area C is 1, even when the core material 74 bends, the cleaning material 76 and the roller portion 70B come into contact with each other effectively. Accordingly, the deterioration (deterioration from an initial stage) of the cleaning performance of the cleaning member 72 caused by the bending of the core material 74 is suppressed.

In addition, in the charging apparatus 22, as the deterioration of the cleaning performance of the cleaning member 72 is suppressed, a charging nonuniformity caused on the charging roller 70 is suppressed.

In addition, in the image forming apparatus 10, as the charging nonuniformity caused on the charging roller 70 is suppressed, the deterioration of quality of the output image is suppressed.

(Second Exemplary Embodiment)

Next, an example of a cleaning member, a charging apparatus, and an image forming apparatus according to a second exemplary embodiment of the present invention will be described with reference to FIGS. 7, 8A and 8B. In addition, the same members as in the first exemplary embodiment are given the same reference numerals, and descriptions thereof will be omitted. The parts different from those in the first exemplary embodiment will be mainly described.

Figure 7:
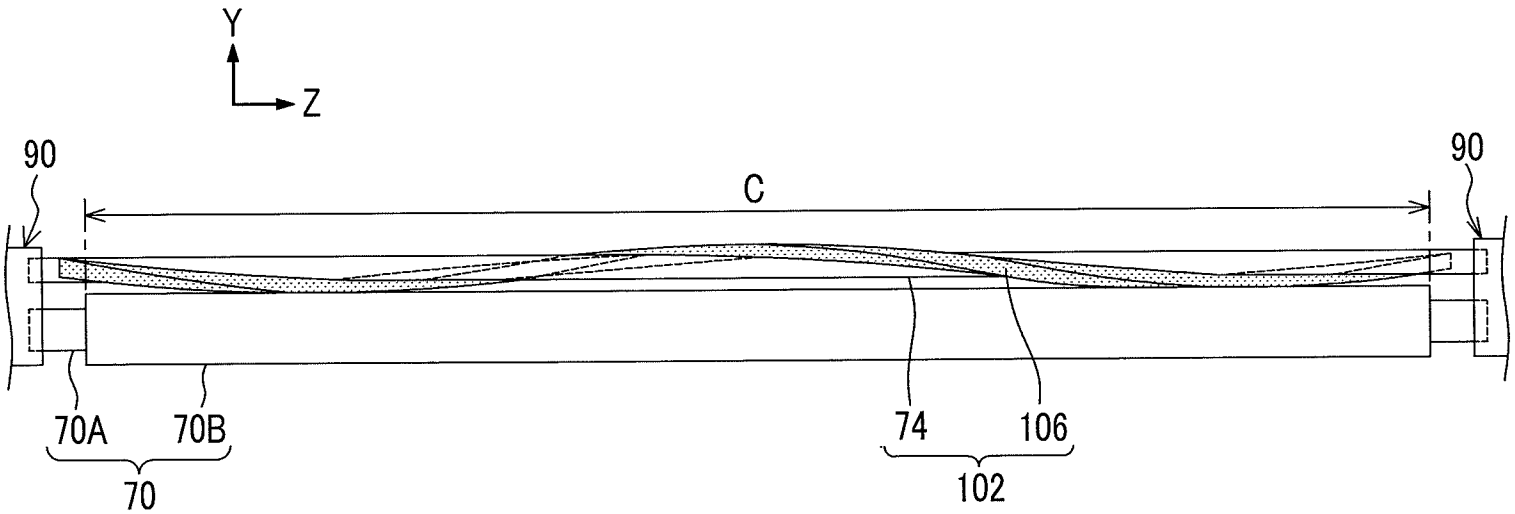
FIG. 7 is a front view illustrating a charging apparatus according to a second exemplary embodiment of the present invention.

As illustrated in FIG. 7, in a cleaning member 102 of the second exemplary embodiment, the number of windings of a cleaning material 106 in the cleaning area C is equal to or greater than 1 and less than 2. As an example, the number of windings is 1.5 (1.5 windings).

In this manner, since the number of windings of the cleaning material 106 with respect to the core material 74 in the cleaning area C is 1.5, when the cleaning member 102 is driven to be rotated by the charging roller 70, the cleaning material 106 and the roller portion 70B come into contact with each other at two locations.

Here, a cleaning member 202 as a comparative embodiment of the cleaning member 102 will be described with reference to FIGS. 8A and 8B.

Figure 8A:
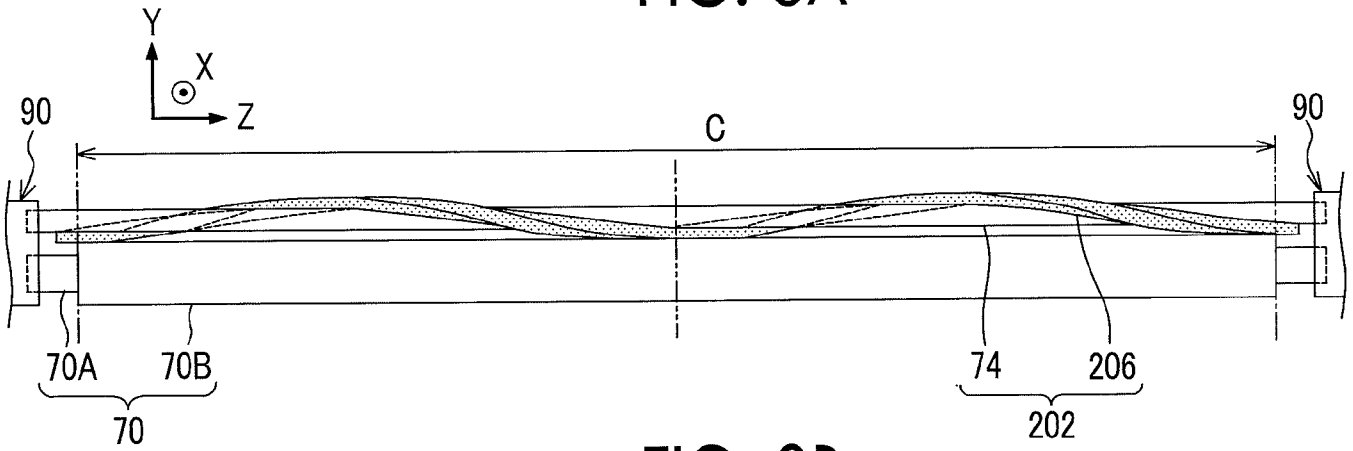
FIGS. 8A and 8B are a front view and a bottom view illustrating a cleaning member according to a comparative embodiment with respect to the cleaning member according to the second exemplary embodiment of the present invention.
Figure 8B:
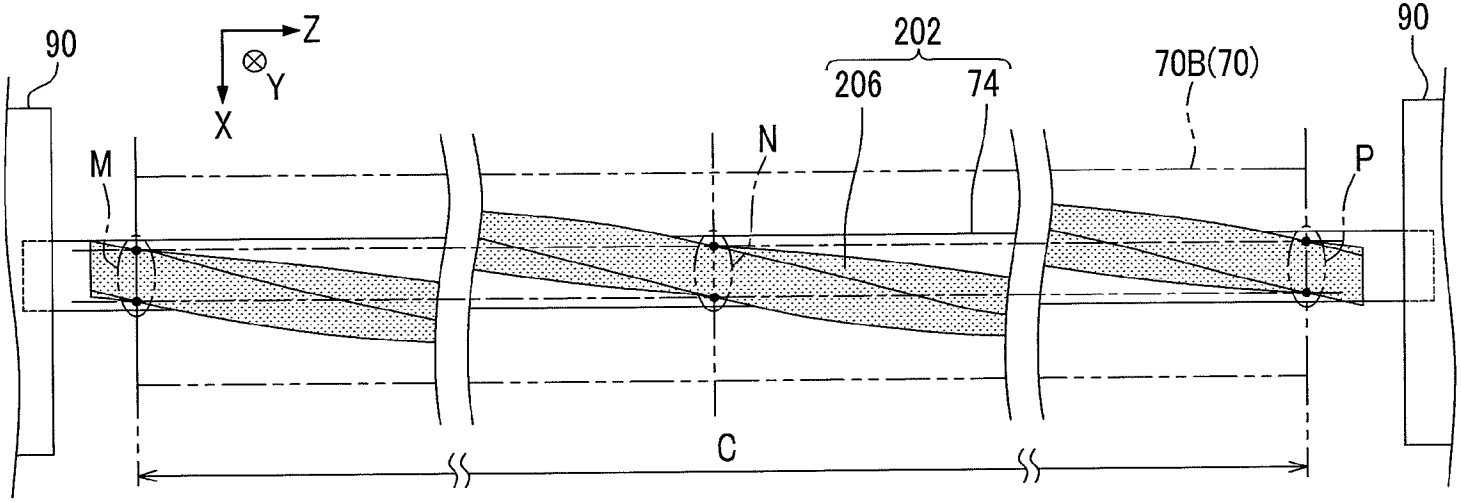

As illustrated in FIG. 8A, in the cleaning member 202, the number of windings of a cleaning material 206 in the cleaning area C is 2 (2 windings). For this reason, when the cleaning material 206 and the roller portion 70B come into contact with each other at both end portions of the cleaning area C, as illustrated in FIG. 8B, even at the center portion of the cleaning area C, the cleaning material 206 and the roller portion 70B come into contact with each other. In this manner, at three locations (M portion, N portion, and P portion in the drawing), the cleaning material 206 and the roller portion 70B come into contact with each other.

Since the M portion and the P portion, at which the cleaning material 206 and the roller portion 70B come into contact with each other at both end portions of the cleaning area C, are close to the supporting member 90, the bending amount of the core material 74 is small. Meanwhile, compared to the M portion and the P portion, the N portion at which the cleaning material 206 and the roller portion 70B come into contact with each other at the center portion of the cleaning area C, is far from the supporting member 90. For this reason, the bending amount of the core material 74 at the N portion is great compared to the M portion and the P portion, and a contact force between the cleaning material 206 and the roller portion 70B at the N portion weakens. Accordingly, in the cleaning member 202 according to the comparative embodiment, the cleaning performance of the cleaning member 202 deteriorates.

Meanwhile, in the cleaning member 102 according to the second exemplary embodiment, the number of windings of the cleaning material 106 with respect to the core material 74 in the cleaning area C is 1.5 which is less than 2. As described above, the cleaning material 106 and the roller portion 70B come into contact with each other at two locations.

For this reason, in the cleaning member 102, unlike the cleaning member 202 according to the comparative embodiment, the deterioration of the cleaning performance caused by the weak contact force of the contact location (N portion) of the center portion due to the contact at three locations does not occur. Accordingly, in the cleaning member 102, compared to the cleaning member 202 according to the comparative embodiment, the deterioration of the cleaning performance of the cleaning member 102 caused by the bending of the core material 74, is suppressed.

In addition, the operation of the charging apparatus 22 and the image forming apparatus 10 is the same as in the first exemplary embodiment.

In addition, a specified exemplary embodiment of the present invention is described in detail, but the present invention is not limited to the exemplary embodiment. It is apparent for those skilled in the art that other various embodiments may be employed within the scope of the present invention. For example, in the above-described exemplary embodiment, the core material 74 is molded with the resin material, but may be molded with a metal material or the like.

Figure 9A:
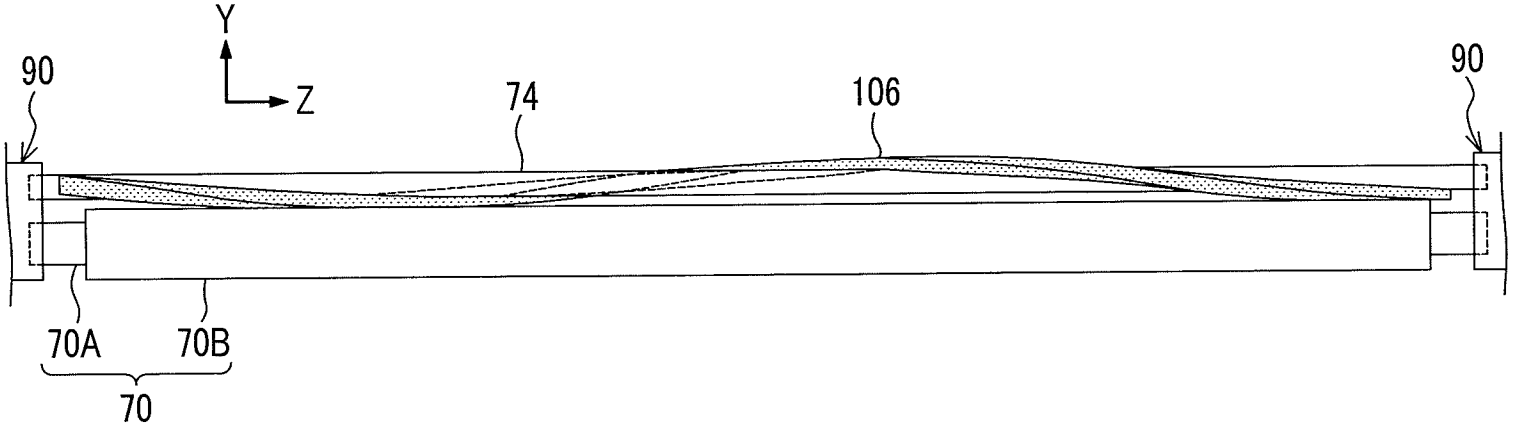
FIGS. 9A and 9B are front views illustrating a modification example of the cleaning member according to the second exemplary embodiment of the present invention.
Figure 9B:
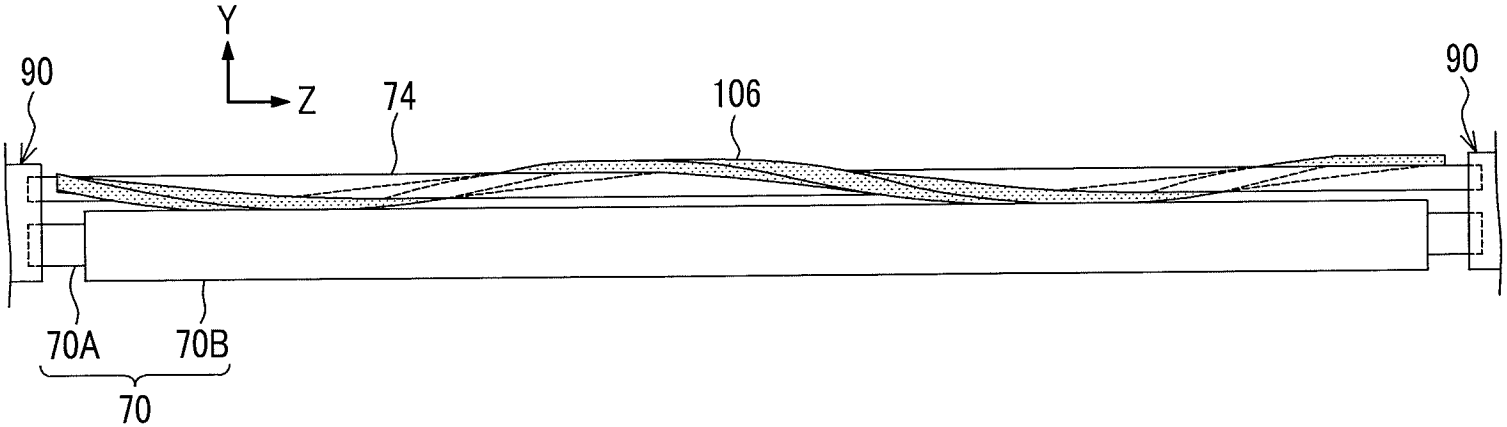

In addition, in the above-described second exemplary embodiment, the number of windings of the cleaning material 106 in the cleaning area C is 1.5 (1.5 windings) as an example. However, the number of windings may be equal to or greater than 1 and less than 2, for example, may be 1.25 (refer to FIG. 9A), and may be 1.75 (refer to FIG. 9B).

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging apparatus, comprising:

a charging member as a member to be cleaned that is driven to be rotated by a rotating image holding member and charges the image holding member; and a cleaning member that is driven to be rotated by the rotating charging member and cleans the charging member, the cleaning member comprising:

a shaft material that rotates about an axial center; and a cleaning material that is spirally wound around the shaft material, is driven to be rotated by a rotating member to be cleaned, cleans the member to be cleaned, and has the number of windings which is equal to or greater than 1 and less than 2 in a cleaning area where the member to be cleaned is cleaned, the cleaning material having a thickness and coupled to a surface of the shaft material and extending above the surface.

2. An image forming apparatus, comprising:

an image holding member;

a charging member as a member to be cleaned that is driven to be rotated by a rotating image holding member and charges the image holding member;

a cleaning member that is driven to be rotated by the rotating charging member and cleans the charging member;

an exposure device that exposes the charged image holding member and forms an electrostatic latent image; and a developing device that develops the electrostatic latent image formed on the image holding member, wherein the cleaning member comprises:

a shaft material that rotates about an axial center; and a cleaning material that is spirally wound around the shaft material, is driven to be rotated by a rotating member to be cleaned, cleans the member to be cleaned, and has the number of windings which is equal to or greater than 1 and less than 2 in a cleaning area where the member to be cleaned is cleaned, the cleaning material having a thickness and coupled to a surface of the shaft material and extending above the surface.

3. The charging apparatus according to claim 1, wherein the shaft material is molded with a resin material or a metal material.

4. The image forming apparatus according to claim 2, wherein the shaft material is molded with a resin material or a metal material.

5. The charging apparatus according to claim 1, wherein the number of windings is 1.

6. The image forming apparatus according to claim 2, wherein the number of windings is 1.

* * * * *